US005510231A

United States Patent [19]

Komatsu et al.

[11] Patent Number: 5,510,231

[45] Date of Patent: Apr. 23, 1996

[54] SOLID DEVELOPING COMPOSITION FOR SILVER HALIDE PHOTOGRAPHIC LIGHT-SENSITIVE MATERIAL AND PROCESSING METHOD USING THE SAME

[75] Inventors: Hideki Komatsu; Shoji Nishio, both of Hino, Japan

[73] Assignee: Konica Corporation, Japan

[21] Appl. No.: 231,398

[22] Filed: Apr. 22, 1994

[30] Foreign Application Priority Data

Apr. 27, 1993 [JP] Japan ..... 5-101152

[51] Int. Cl.[6] ..... G03C 5/18; G03C 5/26

[52] U.S. Cl. ..... 430/399; 430/465; 430/488; 430/490; 430/491

[58] Field of Search ..... 430/399, 465, 430/466, 488, 490, 491, 493

[56] References Cited

U.S. PATENT DOCUMENTS

| | | | |
|---|---|---|---|
| 3,240,603 | 3/1966 | Schüler et al. | 430/458 |
| 4,254,215 | 3/1981 | Kramp et al. | 430/419 |
| 4,310,622 | 1/1982 | Onda et al. | 430/488 |
| 5,385,811 | 1/1995 | Hirano | 430/488 |
| 5,457,009 | 10/1995 | Toyoda et al. | 430/488 |

FOREIGN PATENT DOCUMENTS

| | | | |
|---|---|---|---|
| 518541 | 12/1992 | European Pat. Off. . | |
| 529526 | 3/1993 | European Pat. Off. . | |
| 0566323 | 10/1993 | European Pat. Off. | 430/488 |
| 3-132649 | 6/1991 | Japan | 430/488 |
| 1296161 | 11/1972 | United Kingdom . | |

OTHER PUBLICATIONS

Patent Abstracts of Japan, vol. 16 No. 197 (P–1350); May 1992 JPA–4–29,233; Jan. 1992.

*Primary Examiner*—Charles L. Bowers, Jr.

*Assistant Examiner*—J. Pasterczyk

*Attorney, Agent, or Firm*—Jordan B. Bierman; Bierman and Muserlian

[57] ABSTRACT

A method for processing a silver halide photographic light-sensitive material is disclosed which comprises the steps of:

exposing the light-sensitive material;

developing the exposed material with a developer; and replenishing the developer with a repleniser developer in amount of 200 ml or less per $m^2$ of the material, said developer and replenisher developer are prepared by dissolving in water a solid photographic developing composition comprising a developing agent and a compound selected from the group consisting of compounds represented by the following Formula (5)

wherein $R_1$ and $R_2$ independently represent a hydrogen atom, an alkyl group, an aryl group, an aralkyl group, a hydroxy group, a mercapto group, a carboxyl group, a sulfo group, a phosphono group, an amino group, a nitro group, a cyano group, a halogen atom, an alkoxy group, an alkoxycarbonyl group, an aryloxycarbonyl group, a carbamoyl group, a sulfamoyl group or a heterocyclic group, provided that $R_1$ and $R_2$ may combine to form a ring.

9 Claims, No Drawings

SOLID DEVELOPING COMPOSITION FOR SILVER HALIDE PHOTOGRAPHIC LIGHT-SENSITIVE MATERIAL AND PROCESSING METHOD USING THE SAME

FIELD OF THE INVENTION

The present invention relates to a photographic solid developing composition and a method for processing photographic light-sensitive materials which uses a developer prepared from said solid developing composition. More specifically, the present invention relates to a solid developing composition for silver halide photographic light-sensitive materials and a processing method using the same, which cause neither contrast reduction nor sensitivity fluctuation in continuous processing of low replenishing rate.

BACKGROUND OF THE INVENTION

There has been widely known and practiced a continuous processing system which continuously processes a light-sensitive material in an automatic processor being replenished at a constant rate.

Reduction of waste liquors is urgently needed in recent years for environmental protection, and there has been demanded a realization of stable processing at a replenishing rate as low as possible. Since reduction of the replenishing rate prolongs the retention time of a processing solution in the processor's tank, it causes troubles such as lowering in contrast and fluctuation in sensitivity and thereby hinders the processing from being run stably. Moreover, in replenishers which are supplied to users mostly in the form of concentrated solutions, decomposition and reaction of ingredients in the solutions are liable to proceed, causing fluctuation in photographic properties during continuous processing. And such a fluctuation becomes larger as the replenishing rate becomes smaller. It is useful to supply a solid processing agent to users to have them prepare a processing solution by themselves before use, but it is still inadequate for stable processing.

As a result of studies to solve such problems, the present inventors have found that a replenisher comprising a solid developing composition containing a specific silver-sludge inhibitor scarcely fluctuates in photographic properties such as sensitivity, a $\gamma$ value and a maximum density during continuous processing.

SUMMARY OF THE INVENTION

Accordingly, an object of the present invention is to provide a processing agent showing a stable performance in continuous processing at a low replenishing rate and a processing method using said processing agent.

The above problems are solved by the present invention comprising the following constituents:

(1) a solid developing composition for a silver halide photographic light-sensitive material wherein the composition comprises at least one of compounds represented by the following Formula (1) or (2):

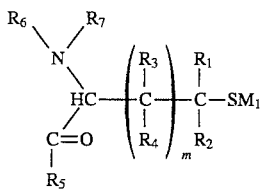

Formula (1)

-continued

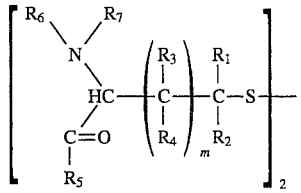

Formula (2)

wherein $R_1$ and $R_2$ independently represent a hydrogen atom or an alkyl group having 1 to 3 carbon atoms, provided that $R_1$ and $R_2$ are not simultaneously hydrogen atoms; $R_3$ and $R_4$ independently represent a hydrogen atom or an alkyl group having 1 to 3 carbon atoms; $R_5$ represents a hydroxyl group, an amino group or an alkyl group having 1 to 3 carbon atoms; $R_6$ and $R_7$ independently represent a hydrogen atom, an alkyl group having 1 to 5 carbon atoms, an acyl group having 18 carbon atoms or less or —$COOM_2$ wherein $M_2$ represents a hydrogen atom, an alkyl group having 1 to 4 carbon atoms, an aralkyl group having 15 carbon atoms or less, an aryl group or an alkali metal atom, provided that $R_6$ and $R_7$ are not simultaneously hydrogen atoms; $M_1$ represents a hydrogen atom, an alkali metal or an ammonium group; and m represents 0, 1 or 2;

(2) a solid developing composition for a silver halide photographic light-sensitive material wherein the composition comprises at least one of compounds represented by the following Formula (3):

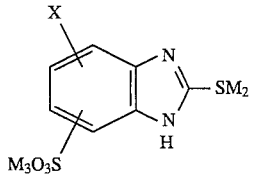

Formula (3)

wherein X represents a hydrogen atom, a hydroxyl group, a lower alkyl group, a lower alkoxy group, a halogen atom, a carboxyl group or a sulfo group; $M_2$ and $M_3$, which may be the same or different, independently represent a hydrogen atom, an alkali metal atom or an ammonium group;

(3) a solid developing composition for a silver halide photographic light-sensitive material wherein the composition comprises at least one of compounds represented by the following Formula (4):

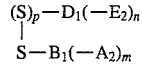

Formula (4)

wherein $D_1$ and $B_1$ independently represent an alkyl group, a cycloalkyl group, an aryl group or a 5- or 6-membered heterocyclic group; $E_2$ and $A_2$ independently represent a formula of —CO—O—M, —$SO_2$—O—M, —S—Z, —$SO_2N(X)(Y)$ or —CON(X)(Y) wherein X, Y and Z independently represent a hydrogen atom, an alkyl or a phenyl group which may have as a substituent a hydroxyl group, a sulfonic acid or a carboxyl group, an alkylsulfonyl group or a phenylsulfonyl group and M represents a monovalent cation such as a hydrogen ion, an alkalimetal ion or an ammonium ion, and when X or Y represents —CO—O—M, $D_1$ and $B_1$ have not an $\alpha$-amino group; p represents 1 or 2; and m and n independently represent an integer of 1 to 3;

(4) a solid developing composition for a silver halide photographic light-sensitive material wherein the composition comprises at least one of compounds represented by the following Formula (5):

Formula (5)

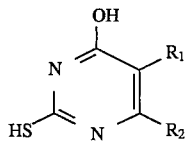

wherein $R_1$ and $R_2$ independently represent a hydrogen atom, an alkyl group (e.g., a lower alkyl group having 4 carbon atoms or less), an aryl group (e.g., a phenyl group), an aralkyl group (e.g., a benzyl group), a hydroxyl group, a mercapto group, a carboxyl group, a sulfo group, a phosphono group, an amino group, a nitro group, a cyano group, a halogen atom, an alkoxy group, an alkoxycarbonyl group, an aryloxycarbonyl group, a carbamoyl group, a sulfamoyl group or a heterocyclic group (e.g., a morpholino group or a pyrrolyl group), provided that $R_1$ and $R_2$ may link to each other to form a ring; and (5) a method for processing a silver halide photographic light-sensitive material which uses a developer prepared from the solid developing composition defined in the foregoing paragraphs (1) to (4), wherein the replenishing amount of the developer is 200 ml or less per square meter of a light sensitive material.

DETAILED DESCRIPTION OF THE INVENTION

The present invention is hereinafter described in detail.

In Formulas (1) and (2), the alkyl group having 1 to 4 carbon atoms includes, for example, a methyl group, an ethyl group, a propyl group and a butyl group.

Examples of the acyl group having 18 carbon atoms or less include an acetyl group and a benzoyl group; examples of the aralkyl group having 15 carbon atoms or less include a benzyl group and a phenethyl group; and examples of the aryl group include a phenyl group and a naphthyl group.

Examples of the alkali metal atom represented by $M_1$ include a sodium atom and a potassium atom.

Various synthesizing methods are known for the above compounds of the invention, and the Strecker synthesis known as a method for synthesizing an amino acid, for example, can be used, and acetylation of an amino acid can be carried out in an aqueous solution by adding an alkali and acetic anhydride alternately.

Typical examples of the compounds represented by Formula (1) or (2) are shown below, but the scope of the invention is not limited to them.

1-1

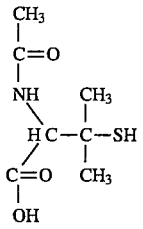

1-2

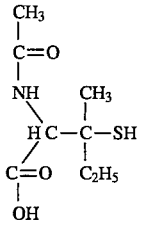

-continued 1-3

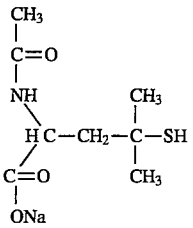

1-4

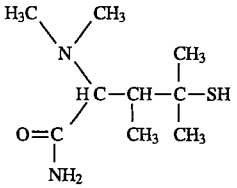

1-5

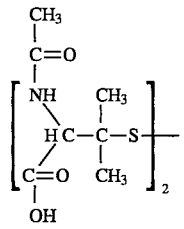

1-6

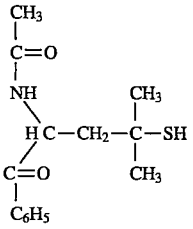

1-7

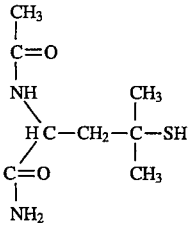

1-8

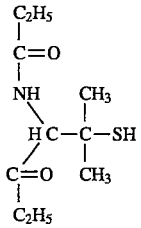

1-9

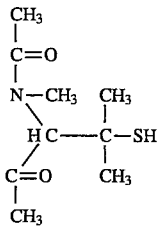

-continued 1-10

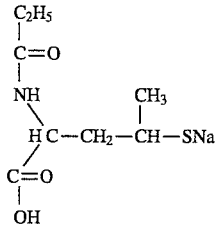

The above compounds of the invention may be used singly or in combination. There may also be used, in combination, at least one compound each of the compounds of Formula (1) and those of Formula (2).

Next, the compounds of the invention represented by Formula (3) are described.

In Formula (3), the lower alkyl group represented by X has 1 to 4 carbon atoms and includes, for example, a methyl group, an ethyl group and a propyl group; the lower alkoxy group so-represented has 1 to 4 carbon atoms and includes, for example, a methoxy group and an ethoxy group; and the halogen atom includes, for example, chlorine and bromine. The alkali metal atom represented by $M_1$ or $M_2$ includes, for example, sodium and potassium.

Typical examples of the compounds represented by Formula (3) are illustrated below, but the scope of the invention is not limited to them.

3-1

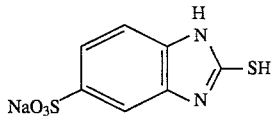

3-2

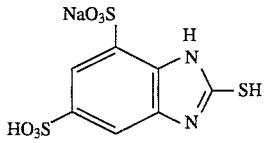

3-3

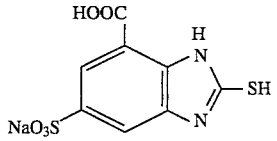

Next, the compounds of the invention represented by Formula (4) are described.

Among the compounds represented by Formula (4), particularly preferred are those having the following Formula (4-1) or (4-2).

Formula (4-1)

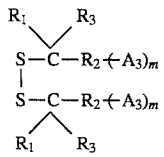

Formula (4-2)

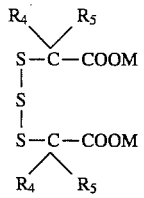

In Formula (4-1), $R_1$ and $R_3$ independently represent a hydrogen atom, a substituted or unsubstituted alkyl (1 to 6 carbon atoms), alkenyl, aralkyl, cycloalkyl or phenyl group, a 5- or 6-membered heterocyclic group having 1 to 3 nitrogen atoms, 1 oxygen atom or 1 sulfur atom, or a carboxylic group; $R_2$ represents a bonding group, an alkylene, alkylidene or phenylene aralkyl group each of which may be substituted, or a formula of —$CONHCH_2$—; $A_3$ represents —COOM or —$SO_3M$ wherein M is a hydrogen atom or an alkali metal atom; and m represents 1 or 2.

In Formula (4-2), $R_4$ and $R_5$ independently represent a hydrogen atom or a methyl group, and M represents a hydrogen atom or an alkali metal atom such as sodium or potassium.

Among the compounds represented by Formula (4-1), preferred are those shown by the following Formula (4-1a).

Formula (4-1a)

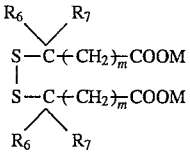

In Formula (4-1a), $R_6$ and $R_7$, which may be the same or different, independently represent a hydrogen atom, a substituted or unsubstituted alkyl group such as —$CH_3$, —$C_2H_5$, —$CH_2OH$ or —$CH_2COOH$, a substituted or unsubstituted cycloalkyl group such as a cyclopentyl or cyclohexyl group, a substituted or unsubstituted phenyl group such as a phenyl, tolyl, p-chlorophenyl, p-aminophenyl, p-sulfophenyl or p-sulfonamidophenyl group, a substituted or unsubstituted 5- or 6-membered heterocyclic group having 1 to 3 nitrogen atoms, 1 oxygen atom or 1 sulfur atom such as a furyl or thienyl group, or a carboxyl group; and m represents an integer of 1 to 4.

Typical examples of the compounds represented by Formula (4-1a) are illustrated below, but the scope of the invention is not limited to them.

4-1

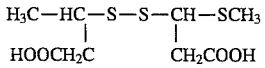

4-2

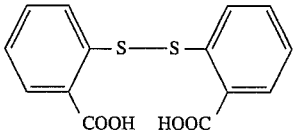

4-3

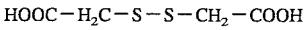

4-4

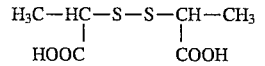

4-5

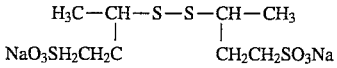

4-6

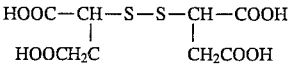

4-7

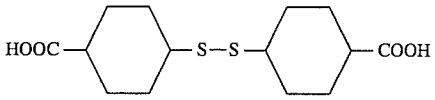

Thiolactic acid 4-8

α-Mercaptoisobutyric acid 4-9

4-10

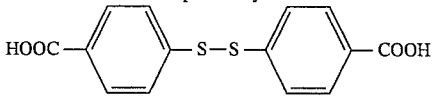

-continued
$HOOC(CH_2)_2-S-S-(CH_2)_2COOH$ 4-11
$HOOC(CH_2)_3-S-S-(CH_2)_3COOH$ 4-12
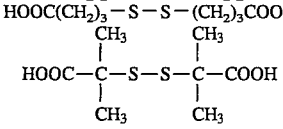
4-13
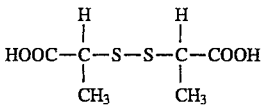
4-14
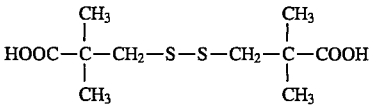
4-15
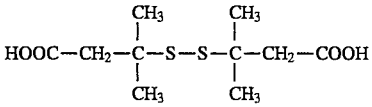
4-16
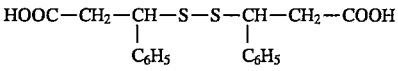
4-17
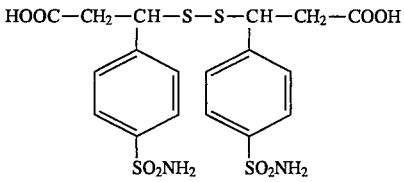
4-18
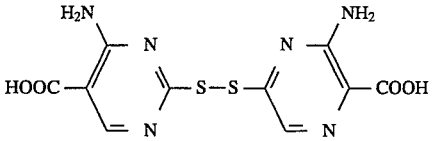
4-19
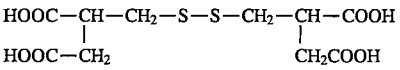
4-20
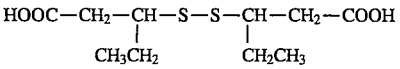
4-21
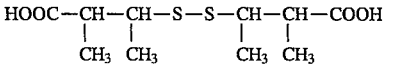
4-22
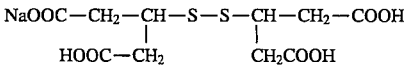
4-23
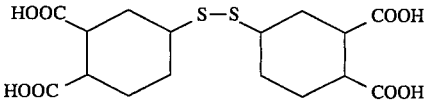
4-24
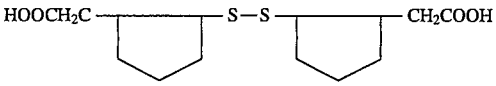
4-25
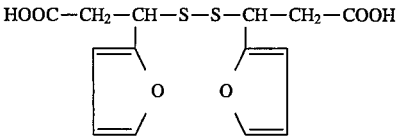
4-26
-continued
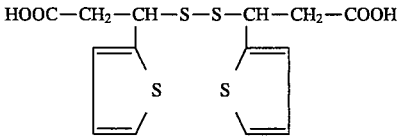
4-27
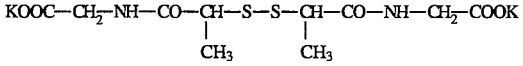
4-28
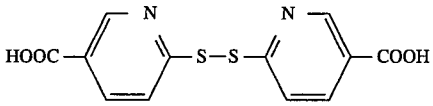
4-29
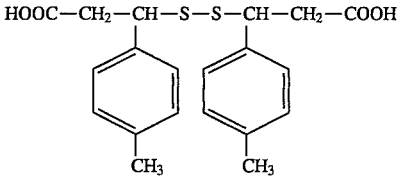
4-30
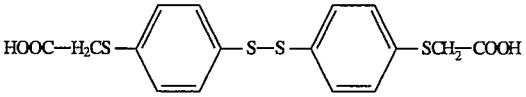
4-31
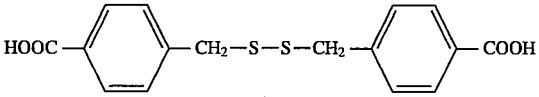
4-32
$HOOC-CH_2-S-S-CH_2-COOH$ 4-33
$HOOCCH_2-CH-S-S-CH-CH_2COOH$ 4-34
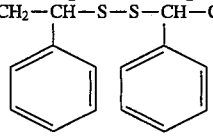
Typical examples of the compounds represented by Formula (5) are illustrated below, but the scope of the invention is not limited to them.
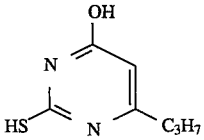
5-1
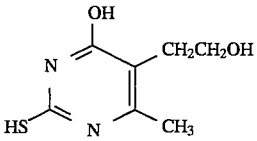
5-2
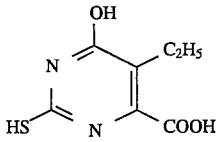
5-3
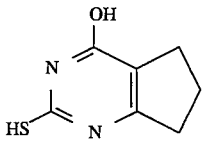
5-4

-continued 5-5

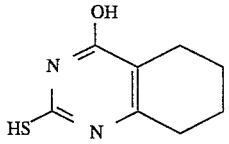

5-6

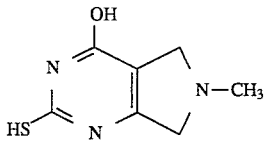

5-7

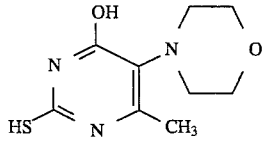

5-8

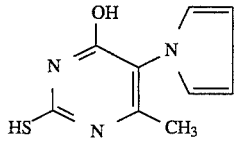

5-9

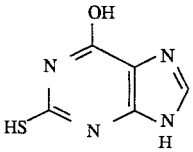

5-10

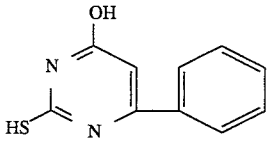

The compounds of the invention represented by the foregoing Formula (1), (2), (3), (4) or (5) may be used singly or in combination.

The compounds of the invention represented by Formulas (1) to (5) respectively are used in an amount of $1\times10^{-5}$ to $3\times^{-2}$ mol, preferably $1\times10^{-4}$ to $1\times10^{-2}$ mol per liter of developer.

The solid developing composition of the invention takes the form of powder, granules or tablets, preferably powder or granules and more preferably granules. The moisture content of the composition is 15 wt % or less, preferably 5 wt % or less and more preferably 0 to 3 wt % or less.

The solid developing composition can be made into granules by stirring granulation or preferred is stirring granulation for its advantage capable of controlling rise in temperature during manufacture.

In carrying out granulation, it is preferable that water or a conventional granulation auxiliary be used as a binder. Suitable granulation auxiliaries are polymers soluble in water or in an alkaline or acid medium. The examples include gelatin, pectin, polyacrylic acid, polyacrylate, polyvinyl alcohol, polyvinyl pyrrolidone, vinyl acetate copolymer, polyethylene oxide, sodium carboxymethyl cellulose, hydroxypropyl cellulose, methyl cellulose, ethyl cellulose, alginate, xanthane gum, gum arabic, tragacanth gum, Karaya gum, carrageenan, methyl vinyl ether, maleic anhydride copolymer, polyoxyethylene alkyl ethers including polyoxyethylene ethyl ether, polyoxyethylene stearyl ether, etc., polyoxyethylene alkylphenyl ethers including polyoxyethylene octhylphenol ether, polyoxyethylene nonylphenol ether, etc., or the water-soluble binders described in Japanese Pat. O.P.I. Pub. No. 85535/1992, each of which may be used singly or in combination.

In respect of reactivity and preservability of ingredients, the solid developing composition of the invention may be supplied as a kit packaged separately in two parts or more, or may be surface-coated or sealed with a packaging material in the form of layers.

The replenishment of processing solutions for silver halide photographic light-sensitive materials is required to be low as far as possible for minimizing environmental pollution. The effect of the invention appears when the replenishing rate of a developer is 250 ml or less per square meter of light-sensitive material, and the effect appears more remarkably when the replenishing rate is 200 ml or less per square meter. The replenishing rate is preferably 100 to 200 ml per square meter.

When the solid developing composition of the invention is for a black and white developer, said solid developing composition may contain the following components.

Developing agents used in the solid developing composition for a black and white developer are preferably combinations of dihydroxybenzenes and 1-phenyl-3-pyrazolidones for their capability of providing favorable photographic properties. Besides the above, p-aminophenol type developing agents may also be used.

Preferred dihydroxybenzene developing agents are, for example, hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone and 2,5-dimethylhydroquinone. Of them, hydroquinone is particularly preferred.

As developing agents of 1-phenyl-3-pyrazolidone and its derivatives, 1-phenyl-4,4-dimethyl-3-pyrazolidone, 1-phenyl-4-methyl- 4-hydroxymethyl-3-pyrazolidone and 1-phenyl-4,4-dihydroxymethyl- 3-pyrazolidone are preferred.

Suitable p-aminophenol type developing agents are, for example, N-methyl-p-aminophenol, p-aminophenol, N-(β-hydroxyethyl)-p-aminophenol, N-(4-hydroxyphenyl)glycine, 2-methyl-p-aminophenol and p-benzylaminophenol. Of them, N-methyl-p-aminophenol is preferred.

These developing agents are usually employed in an amount of 0.01 to 1.2 mol per liter of a developing solution used in processing.

The solid developing composition of the invention may contain, as a preservative, a sulfite such as sodium sulfite, potassium sulfite, lithium sulfite, ammonium sulfite, sodium bisulfite, potassium metabisulfite or sodium formaldehyde bisulfite. Such a sulfite is used preferably in an amount of 0.2 mol or more, especially 0.4 mol or more per liter of a developing solution used in processing. Preferably, the upper limit of the addition is 2.5 mols per liter.

The solid developing composition may contain an alkali agent and a pH buffer as pH adjustors. Suitable alkali agents for this purpose include pH regulators such as sodium hydroxide, potassium hydroxide, sodium carbonate, trisodium phosphate and tripotassium phosphate. The effect of the invention, especially prevention of pepper spots and improvement in sharpness in processing of a hydrazine-containing light-sensitive material as well as prevention of pinholes and improvement in sharpness in processing of a tetrazolium-containing light-sensitive material, is brought about more remarkably when the pH is 10 or more.

The solid developing composition may contain a buffer selected from borates, 5-sulfosalicylic acid, phosphates and carbonates.

Besides the above ingredients, the solid developing composition may contain a developing inhibitor such as sodium bromide, potassium bromide or potassium iodide; an organic solvent such as ethylene glycol, diethylene glycol, triethylene glycol, dimethyl formamide, methyl cellosolve, hexylene glycol, ethanol or methanol; and an antifoggant selected from mercapto compounds such as 1-phenyl-5-mercaptotetrazole and sodium 2-mercaptobenzimidazole-5-sulfonate, indazole compounds such as 5-nitroindazole and benzotriazole compounds such as 5-methylbenzotriazole. If necessary, there may also be contained a tone controlling agent, a surfactant, a defoamer, a water softener and an amino compound described in Japanese Pat. O.P.I. Pub. No. 106244/1981.

EXAMPLES

The invention is described in more detail with the following examples.

EXAMPLE 1

Preparation of Silver Halide Photographic Light-sensitive Material for Evaluation Synthesis of Latex Lx While stirring at 80° C. in a nitrogen atmosphere a solution prepared by dissolving 0.125 kg of gelatin and 0.05 kg of ammonium persulfate in 40 l of water, a mixture of (a) 4.5 kg of n-butyl acrylate, (b) 5.49 kg of styrene and (c) 0.1 kg of acrylic acid was added thereto in 1 hour. After the addition, the reaction mixture was stirred for 1.5 hours, and then 1.25 Kg of gelatin and 0.005 kg of ammonium persulfate were added, followed by stirring for 1.5 hours. After completion of the reaction, the reaction mixture was subjected to steam distillation for 1 hour to remove the residual monomers, cooled to room temperature and adjusted to pH 6.0 with aqueous ammonia. The resulting latex was made up to 50.5 kg with the addition of water.

The latex thus obtained comprised monodispersed particles having an average particle diameter of 0.25 μm and a Tg of about 0° C.

Preparation of Emulsion A

A silver nitrate solution, and a solution prepared by dissolving hexachlororhodium complex in an aqueous solution containing sodium chloride and potassium bromide so as to give a complex concentration of $8\times10^{-5}$ mol/Ag mol, were simultaneously added to a gelatin solution while controlling the flow rate, followed by desalting. The silver chlorobromide emulsion thus obtained comprised monodispersed cubic crystal grains having an average grain size of 0.13 μm and a silver bromide content of 1 mol %.

This emulsion was subjected to sulfur sensitization in the usual manner and stabilized by the addition of 6-methyl-4-hydroxy- 1,3,3a,7-tetrazaindene. After dividing the emulsion into parts, the following additives were added to each part to obtain emulsion coating solutions E-1 to E-14. Subsequently, coating solution P-O for protecting emulsion layer, coating solution B-O for backing layer and coating solution BP-O for protecting backing layer, which had the following compositions, were prepared.

| | |
|---|---|
| Compound (a) | 1 mg/m$^2$ |
| NaOH (0.5N) | to adjust the pH to 5.6 |
| Compound (b) | 50 mg/m$^2$ |
| Compound (c) | 30 mg/m$^2$ |
| Saponin (20%) | 0.5 ml/m$^2$ |
| Sodium dodecylbenzene sulfonate | 20 mg/m$^2$ |
| 5-Methyl-benzotriazole | 10 mg/m$^2$ |
| Compound (d) | 2 mg/m$^2$ |
| Compound (e) | 10 mg/m$^2$ |
| Compound (f) | 6 mg/m$^2$ |
| Latex Lx | 0.5 g/m$^2$ |
| Styrene-maleic acid copolymer (thickener) | 90 mg/m$^2$ |

(a)

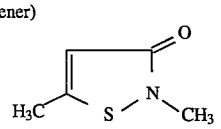

(b)

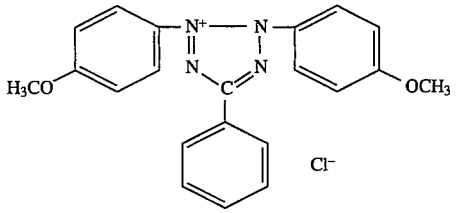

(c)

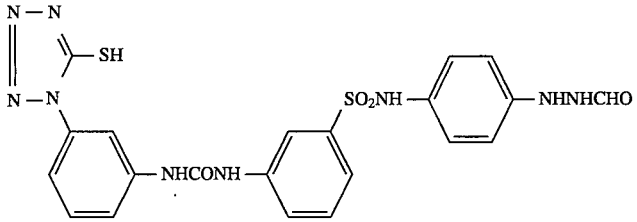

-continued (d)

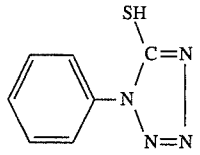

(e)

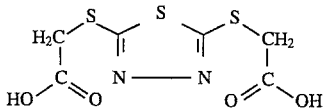

(f)

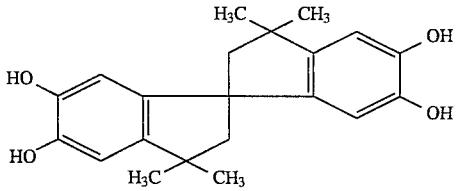

Coating Solution P-O for Protecting Emulsion Layer

| | |
|---|---|
| Gelatin | 0.5 g/m$^2$ |
| Compound (g) (1%) | 25 ml/m$^2$ |
| Compound (h) | 120 mg/m$^2$ |
| Spherical monodispersed silica (8 μm) | 20 mg/m$^2$ |
| Spherical monodispersed silica (3 μm) | 10 mg/m$^2$ |
| Compound (i) | 100 mg/m$^2$ |
| Citric acid | to adjust the pH to 6.0 |

Coating Solution B-O for Backing Layer

| | |
|---|---|
| Gelatin | 1.0 g/m$^2$ |
| Compound (j) | 100 mg/m$^2$ |
| Compound (k) | 18 mg/m$^2$ |
| Compound (1) | 100 mg/m$^2$ |
| Saponin (20%) | 0.6 ml/m$^2$ |
| Latex (m) | 300 mg/m$^2$ |
| 5-Nitroindazole | 20 mg/m$^2$ |
| Styrene-maleic acid copolymer (thickener) | 45 mg/m$^2$ |
| Compound (o) | 30 mg/m$^2$ |

Coating Solution BP-O for Protecting Backing Layer

| | |
|---|---|
| Gelatin | 0.5 g/m$^2$ |
| Compound (g) (1%) | 2 ml/m$^2$ |
| Spherical polymethylmethacrylate (4 μm) | 25 mg/m$^2$ |
| Sodium chloride | 70 mg/m$^2$ |
| Compound (n) | 10 mg/m$^2$ |

(g)

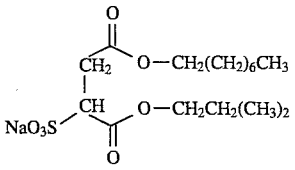

(h)

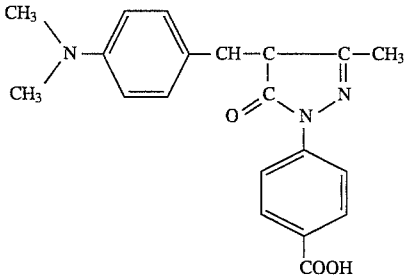

(solid disperse dye)

-continued (i)

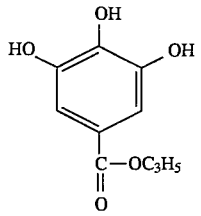

(j)

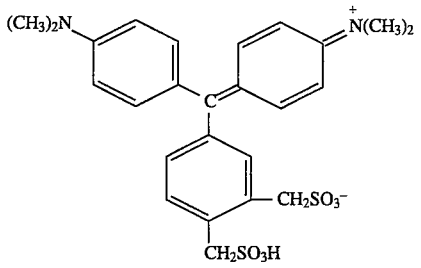

(k)

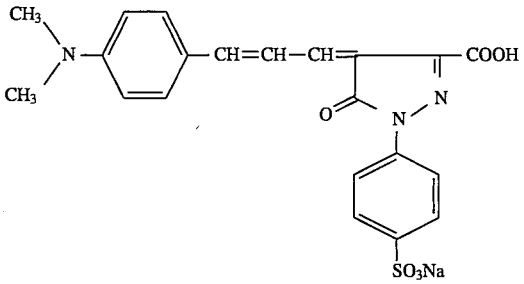

(l)

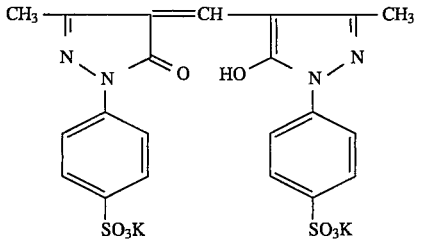

(m)

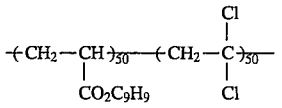

(n)

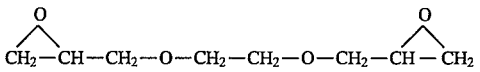

(o)

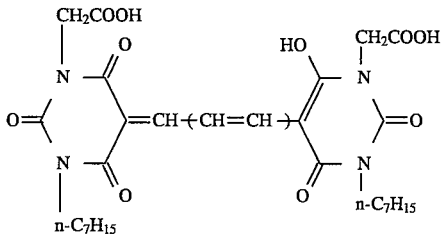

After subjecting a 100-μm thick polyethylene terephthalate support provided with a subbing layer described in Japanese Pat. O.P.I. Pub. No. 19941/1984 to corona discharge treatment at 10 W/m$^2$·min, a solution for an antistatic layer of the following composition was coated on one side of the support using a roll feed coating pan and an air-knife. Then, the coated support was dried for 30 seconds at 90° C. under parallel current drying conditions which gave an overall heat transfer coefficient of 25 Kcal/m$^2$·hr·°C., followed by further drying at 140° C. for 90 seconds. The dry thickness of this layer was 1 μm, and the surface specific resistance of this layer was $1\times10^8$ Ω at 23° C. and 55% RH.

Solution for an antistatic layer

| | |
|---|---|
| Water soluble polymer (Mn = 5000) | 70 g/l |

-continued

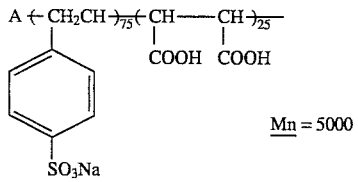

Mn = 5000

Hydrophobic polymer particles 40 g/l

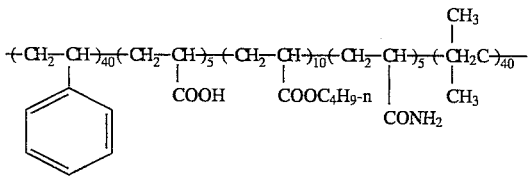

| | |
|---|---|
| Ammonium sulfate | 0.5 g/l |
| Polyethylene oxide compound (average molecular weight: 600) | 6 g/l |
| Hardener mixture of | 12 g/l |

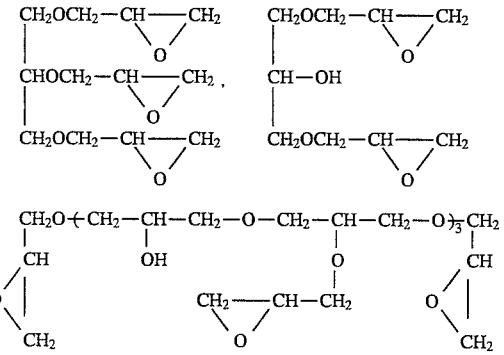

and 7 g/l (5:3:2, weight ratio)

As the emulsion layer side, an emulsion layer and a protective layer for emulsion were formed in this order on the surface of the support opposite to the antistatic layer by simultaneous, doublelayered coating using the above-obtained coating solutions, while adding the following hardener solution to the coating solutions kept at 35° C. by use of a slide hopper. After passing the resulting material through a cold-air setting zone kept at 5° C., a backing layer and a protective backing layer were formed likewise using a slide hopper while adding the following hardener solution to the above obtained solutions, followed by cold air setting at 5° C. When the coated material came out of the respective setting zones, each coating solution exhibited adequate setting. Then, both sides of the base were dried simultaneously in a drying zone under the following drying conditions. Meanwhile, after completion of coating on the backing layer side, the base was conveyed using a roller till it was wound up, but before that it was conveyed without touching any transporting member. The coating speed was 100 m/min.

| Hardner Solution | |
|---|---|
| Hardener Solution for the Protecting Emulsion Layer | |
| Formalin (an aqueous 3.7 weight % formalin solution) | 0.10 g/m² |

-continued

| Hardner Solution | |
|---|---|
| Hardener Solution for the Backing Layer | |
| Glyoxal (an aqueous 4 weight % glyoxal solution) | 0.10 g/m² |
| Hardener Solution for the Protecting Backing Layer | |
| Glyoxal (an aqueous 4 weight % glyoxal solution) | 0.10 g/m² |

Drying Conditions

After setting, the resulting material was first dried by sending dry air of 30° C. till the weight ratio of $H_2O$/gelatin reached 800% and further dried by sending dry air kept at 35° C. and 30% RH till the moisture ratio decreased from 800% to 200%. The air blast was continued as it was, and 30 seconds after the surface temperature reached 34° C. (regarded to be the completion of drying), final drying was performed for 1 minute with air of 48° C. and 16% RH. In the above process, drying from the start to the $H_2O$/gelatin ratio of 800% took 50 seconds, drying from 800% to 200% 35 seconds and drying from 200% to the end 5 seconds.

The light-sensitive material prepared as above was wound up at 23° C. and 15% RH and, then, cut into a desired size in the same environment.

| Preparation of Solid Developing Composition | | |
|---|---|---|
| A-1 | (per liter of developer) | |
| | EDTA.2Na | 1 g |
| | Hydroquinone | 15 g |
| | Phenidone | 0.5 g |
| | Potassium bromide | 45 g |
| | Sodium sulfite | 40 g |
| | Compound of Formula (1) to (5) shown in Table 1 | |
| A-2 | (per liter of developer) | |
| | Sodium carbonate | 50 g |
| | Sodium hydrogencarbonate | 3 g |
| | 5-Methylbenzotriazole | 6.16 g |
| | 1-Phenyl-5-mercaptotetrazole | 0.06 g |
| | 5-Nitroindazole/ISOERITO P*/NaOH | 0.11 g/5 g/4.3 g |

5-Nitroindazole/ISOERITO P/NaOH was prepared by mixing them and milling the mixture into particles less than 0.3 mm in size.
*ISOERITO P is cyclodextrin made by ENSUIKO SEITO Co. Ltd.

The above compositions A-1 and A-2 were each mixed separately and then hammer-milled into particles having a particle size less than 0.5 mm.

Water was added to each of the milled compositions so as to make the moisture content 5 wt %, followed by kneading.

After kneading, each composition was formed into granules having a particle diameter of 2 to 3 mm by use of an extrusion granulator.

The resulting granules were allowed to stand for 24 hours in an atmosphere of 50° C. and 20% relative humidity to obtain a granule sample for evaluation having a moisture content of 2 wt %.

| Preparation of Concentrated Developing Composition for Comparison | | |
|---|---|---|
| B-1 | (per liter of developer) | |
| | Deionized water | 165 g |
| | EDTA.2Na | 1 g |
| | Sodium carbonate | 50 g |

-continued

| Preparation of Concentrated Developing Composition for Comparison | | |
|---|---|---|
| | Sodium sulfite | 40 g |
| | Sodium hydrogencarbonate | 3 g |
| | Diethylene glycol | 50 g |
| | Hydroquinone | 15 g |
| | Potassium bromide | 4.5 g |
| | 5-Methylbenzotriazole | 0.16 g |
| | 1-Phenyl-5-mercaptotetrazole | 0.02 g |
| | Compound of Formula (1) to (5) shown in Table 1 | |
| B-2 | (per liter of developer) | |
| | Deionized water | 9 g |
| | Acetic acid (90% aqueous solution) | 0.3 ml |
| | Diethylene glycol | 50 g |
| | 5-Nitroindazole | 0.11 g |
| | Phenidone | 0.5 g |

Compositions A-1, A-2, B-1 and B-2 were each contained in a polyethylene container airtightly and allowed to stand for 1 week in an atmosphere of 50° C. and 80% RH. Then, compositions A-1 and A-2 were joined and dissolved so as to give 1 liter of solution, and compositions B-1 and B-2 were mixed together with water and made up to 1 liter. Thus, developer and replenishing developer were prepared to obtain sample Nos. 1-1 to 1-25.

Continuous processing was conducted using the above-obtained developer, replenishing developer and light-sensitive material samples having a size of 610 mm×508 mm with a Konica Automatic Processor GR-27 for 14 days, at a processing rate of 100 sheets per day (black portion ratio: 20%) under the following processing conditions. Twenty percent of an area of the light-sensitive material was exposed using Room-light Printer P627FM produced by Fusion Co. Ltd. Then, photographic sensitivity was evaluated. The results are shown in Table 1. In the processing, Konica CFL.871 was used as a fixer.

Sensitivity was determined by measuring the transmission density of a processed film with a Konica Digital Densitometer PDA-65 and calculating the reciprocal of exposure necessary to give a density of 2.5. The relative sensitivity in Table 1 is expressed in a value relative to sensitivity of sample No. 1- 18 which is set at 100.

| Process | Temperature | Time |
|---|---|---|
| Developing | 28° C. | 30 sec |
| Fixing | 28° C. | 20 sec |
| Washing | 20° C. | 20 sec |
| Drying | 45° C. | 20 sec |

TABLE 1

| Sample No. | Form of Developing Composition | Compound of Formula (1) to (5) | Amount Added ($\times 10^{-3}$ mol/l) | Replenishing Rate of Developer | Relative Sensitivity | Remarks |
|---|---|---|---|---|---|---|
| 1-1 | Granules | — | — | 150 | 70 | Comparison |
| 1-2 | Granules | 1–1 | 1 | 150 | 94 | Invention |
| 1-3 | Granules | 1–5 | 1 | 150 | 95 | Invention |
| 1-4 | Granules | 3–1 | 1 | 150 | 93 | Invention |
| 1-5 | Granules | 3–3 | 1 | 150 | 92 | Invention |
| 1-6 | Granules | 4–30 | 1 | 150 | 94 | Invention |
| 1-7 | Granules | 4–34 | 1 | 150 | 94 | Invention |
| 1-8 | Granules | 5–9 | 1 | 150 | 96 | Invention |
| 1-9 | Concentrated Solution | — | — | 150 | 58 | Comparison |
| 1-10 | Concentrated Solution | 1–1 | 1 | 150 | 59 | Comparison |
| 1-11 | Concentrated Solution | 1–5 | 1 | 150 | 56 | Comparison |
| 1-12 | Concentrated Solution | 3–1 | 1 | 150 | 57 | Comparison |
| 1-13 | Concentrated Solution | 3–3 | 1 | 150 | 56 | Comparison |
| 1-14 | Concentrated Solution | 4–30 | 1 | 150 | 58 | Comparison |
| 1-15 | Concentrated Solution | 4–34 | 1 | 150 | 56 | Comparison |
| 1-16 | Concentrated Solution | 5–9 | 1 | 150 | 56 | Comparison |
| 1-17 | Granules | 5–9 | 1 | 250 | 100 | Invention |
| 1-18 | Granules | 5–9 | 1 | 200 | 100 | Invention |
| 1-19 | Granules | 5–9 | 1 | 150 | 94 | Invention |
| 1-20 | Granules | 5–9 | 1 | 100 | 93 | Invention |
| 1-21 | Granules | 5–9 | 1 | 80 | 83 | Invention |
| 1-22 | Concentrated Solution | 5–9 | 1 | 200 | 75 | Comparison |
| 1-23 | Concentrated Solution | 5–9 | 1 | 150 | 59 | Comparison |
| 1-24 | Concentrated Solution | 5–9 | 1 | 100 | 43 | Comparison |
| 1-25 | Concentrated Solution | 5–9 | 1 | 80 | 30 | Comparison |

It can be seen in Table 1 that the present invention can noticeably reduce sensitivity fluctuation in continuous processing as compared with conventional concentrated developers, and that the method of the present invention can prevent a lowering of sensitivity even when the replenishing rate of a developer is low.

What is claimed is:

1. A method for processing a black and white silver halide photographic light-sensitive material comprising:

exposing the light-sensitive material;

developing the exposed material with a developer; and replenishing the developer with a developer replenisher in an amount of 200 ml or less per $m^2$ of the material, said developer and developer replenisher being prepared by dissolving in water a solid photographic developing composition comprising a developing agent and a compound of Formula (5), said developer comprising from $1\times10^{-5}$ to $3\times10^{-2}$ mol per liter of said developing agent; and fixing the developed photographic material with a fixer;

Formula (5)

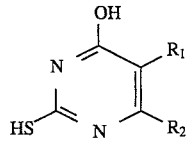

wherein $R_1$ and $R_2$ independently represent a hydrogen atom, an alkyl group, an aryl group, an aralkyl group, a hydroxy group, a mercapto group, a carboxyl group, a sulfo group, a phosphono group, an amino group, a nitro group, a cyano group, a halogen atom, an alkoxy group, an alkoxycarbonyl group, an aryloxycarbonyl group, a carbamoyl group, a sulfamoyl group or a heterocyclic group, provided that $R_1$ and $R_2$ may combine to form a ring.

2. The process of claim 1 wherein said replenishing with said developer replenisher is carried out in an amount of 100 to 200 ml/$m^2$ of said material.

3. The process of claim 1 wherein said developer comprises $1\times10^4$ to $1\times10^{-2}$ mol of said compound per liter of said developer.

4. A solid photographic developing composition for a silver halide photographic light-sensitive material, comprising a developing agent and a compound represented by Formula (5):

Formula (5)

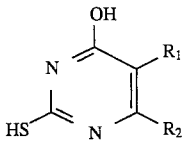

wherein $R_1$ and $R_2$ independently represent a hydrogen atom, an alkylene group, an arylene group, an aralkylene group, a hydroxy group, a mercapto group, a carboxyl group, a sulfo group, a phosphono group, an amino group, a nitro group, a cyano group, a halogen atom, an alkoxy group, an alkoxycarbonyl group, an aryloxycarbonyl group, a carbamoyl group, a sulfamoyl group or a heterocyclic group, provided that $R_1$ and $R_2$ may combine to form a ring.

5. The solid composition of claim 4, wherein the moisture content of said composition is 15% or less by weight.

6. The solid composition of claim 5, wherein the moisture content of said composition is 5% or less by weight.

7. The solid composition of claim 6, wherein the moisture content of said composition is 0 to 3% by weight.

8. The solid composition of claim 4, further containing a water-soluble binder.

9. The solid composition of claim 8, wherein said water-soluble binder is selected from polyethyleneoxide, gelatin, hydroxypropylcellulose and xanthane gum.

* * * * *